United States Patent [19]

Langner et al.

[11] Patent Number: 4,818,280

[45] Date of Patent: Apr. 4, 1989

[54] PROCESS FOR PRODUCING NONFERROUS METAL POWDER

[75] Inventors: Bernd Langner, Winsen/Luhe; Artur May, Meckelfeld; René-Holger Wilde, Badendorf, all of Fed. Rep. of Germany

[73] Assignee: Norddeutsche Affinerie Aktiengesellschaft, Hamburg, Fed. Rep. of Germany

[21] Appl. No.: 178,717

[22] Filed: Apr. 7, 1988

[30] Foreign Application Priority Data

Apr. 7, 1987 [DE] Fed. Rep. of Germany ..... 3711650

[51] Int. Cl.[4] ..... B22F 9/24

[52] U.S. Cl. ..... 75/0.5 A; 75/0.5 AA; 75/108

[58] Field of Search ..... 75/0.5 A, 0.5 AA, 108, 75/117, 118 R, 119, 120, 121

[56] References Cited

U.S. PATENT DOCUMENTS

| | | | |
|---|---|---|---|
| 3,694,185 | 9/1972 | Kunda et al. | 75/0.5 A |
| 3,876,747 | 4/1975 | Pittie et al. | 75/108 |
| 3,912,498 | 10/1975 | Taylor | 75/108 |
| 4,018,595 | 4/1977 | Genik-Sas-Berzowsky | 75/0.5 A |
| 4,539,041 | 9/1985 | Figlarz et al. | 75/0.5 A |

*Primary Examiner*—Wayland Stallard
*Attorney, Agent, or Firm*—Herbert Dubno

[57] ABSTRACT

Nonferrous metal powder or nonferrous metal powder mixtures are made by reacting a metal compound in an aqueous medium with an aqueous sugar or starch solution with stirring and optionally at an elevated temperature and the precipitated metal powder is separated. The nonferrous metal oxide or hydroxide in a concentration between 20 and 400 g/l (calculated as metal) is treated in the aqueous medium at a pH-value above 3.2 and at a temperature between 20° and 160° C. and the virtually oxide free nonferrous metal powder which is precipitated is separated. Oxides or hydroxides of the metals Cu, Ag, Ni, Co, Sn, Pb, Sb, As, or Bi are used.

12 Claims, 2 Drawing Sheets

PROCESS FOR PRODUCING NONFERROUS METAL POWDER

FIELD OF THE INVENTION

Our present invention relates to a process for producing a nonferrous metal powder or nonferrous metal powder mixtures by reacting a metal compound in an aqueous medium with an aqueous sugar or starch solution with stirring and optionally at an elevated temperature so that the precipitated metal powder can be separated.

BACKGROUND OF THE INVENTION

Powder metallurgy is very important in the production of catalysts and or sintered bodies, such as metal filters, and in the fabrication of novel alloy systems and dispersion-hardened materials.

Powder metallurgy can also be used in the production of composite materials, which are used mainly in the electronics field and in which firm bonds are required between components that are immiscible in a liquid state. Such composites may comprise ceramic-metal, plastic-metal and metal-metal combinations.

The processes of producing metal powders comprises electrodeposition, the spraying of molten metals, and chemical precipitation, and result in powders which have different properties. Very fine powders are mainly obtained by chemical precipitation.

It is known that metal powders can be precipitated by a reduction of metal salt-containing solutions, e.g., with hydrogen (Sherrit-Gordon process). But that process results in particle size distributions in relative wide ranges and in particles having different shapes. Whereas the particle size distribution in the production of copper powder can be influenced by additives, such as polymeric amino compounds (Published German Application No. 26 53 281, U.S. Pat. No. 4,018,595) or ethylene/maleic anhydride copolymers (Published German Application No. 21 32 173, U.S. Pat. No. 3,694,185), the averge particle size of the resulting powder will always exceed 10 m.

From U.S. Pat. No. 4,539,041, it is known to reduce compounds of nonferrous metals, such as Au, Pd, Pt, Ir, Os, Cu, Ag, Ni, Co, Pb or Od in virtually anhydrous polyols to metals at temperatures of at least 85° C. and up to 350° C. The precipitate generally has a particle size between 0.1 and 10 μm.

Disadvantages of the process are the fact that high temperatures are required to obtain a particle size below 0.5 μm and that the reducing agents which can be used are restricted to polyols which are liquid at a reduction temperatures.

Another disadvantage of the process is the high consumption of expensive chemicals in an amount which is more than 20 times of the amount of copper that is produced.

From "Aust. Chem. Eng.", November 1983, pages 9 to 15, it is also known that copper sulfate in acid solutions can be reduced to fine copper powders by a treatment with starch or various sugars at pH values below 3.2 and in concentrations of 16 q/1 copper whereas basic sulfates will be formed and only a reduction to the Cu(I) oxide can be effected at pH values above 2.9.

That process has the disadvantage that the product is contaminated with sulfur owing to the sulfate content of the solution and the quantity of copper which can be produced per unit volume of the solution is limited by the solubility of copper sulfate.

OBJECT OF THE INVENTION

It is an object of the invention to provide an improved process for the production of nonferrous metal powders which is convenient and economical and which does not require expensive equipment, while yielding very fine nonferrous metal powders without the disadvantages involved in the known processes, particularly those discussed hereinbefore.

SUMMARY OF THE INVENTION

This object is accomplished in accordance with the invention in a process of producing nonferrous metal powder or nonferrous metal powder mixtures, wherein a metal compound is treated in an aqueous medium with an aqueous sugar or starch solution with stirring and optionally at an elevated temperature and the precipitated metal powder is separated.

According to the invention, nonferrous metal oxide or hydroxide in a concentration between 20 and 400 g/l (calculated as metal) is treated in the aqueous medium at a pH-value above 3.2 and at a temperature between 20 to 160° C. and the virtually oxide free nonferrous metal powder which is precipitated is separated.

In the process according to the invention the nonferrous metal oxide or hydroxide is suspended in a solution of a sugar or starch and in a stirred reactor is heated to temperatures up to 160° C. under atmospheric pressure.

Instead of a metal oxide or hydroxide, a metal salt may be used as a starting material and such salt may be transformed to the hydroxide or a difficulty soluble basic salt by an addition of alkali.

The nonferrous metal compounds and the sugar or starch are used in approximately equal parts by weight although a larger quantity of sugar or starch by weight is preferred.

The term "sugar' is used in known manner to cover mono-or oligosaccharides, i.e., organic compounds having one carbonyl function and a plurality of hydroxyl functions in the molecule. In such substances, simple compounds (monosaccharides) tend to combine to form larger molecules (di- or oligosaccharides) with elimination of water.

Examples of suitable sugar or sugar derivatives are monosaccharides, such as pentoses, hexoses (fructose, glucose), gluconic acids and lactones, such as gluconic acid-delta-lactone, also dissaccharides, such as saccharose, maltose.

The reduction process usually takes some hours. After that time the reaction product is decanted, washed and centrifuged and is dried under a protective gas, such as nitrogen.

In the process of the invention the nonferrous metal oxide or hydroxide is preferably used in a concentration between 70 to 300 g/l (calculated as metal). In the aqueous medium the reaction mixture comprising nonferrous metal oxide or hydroxide and sugar or starch constitutes a dense suspension having a high solids content. As the reduction rate will obviously be increased by an elevated temperature, a temperature between 70° C. and 150° C. is suitably maintained in the reaction medium.

It has also been found that the reaction can be accelerated by an addition of an oxidizer and that the reaction time can be reduced to approximately one-half in that manner. Examples of suitable oxidizers are hydrogen peroxide and its alkali salts. Such an addition is effected in an amount between 0.5 and 5% related to the quantity of dry sugar or starch.

In the process in accordance with the invention the primary particle size of the precipitated nonferrous metal powder can be controlled within certain limits. In the particle size range from 0.1 to 30 μm that control is effected by the selection of the pH value in the reaction medium. At pH values in the range from above 3.2 to 14 and higher as far as to concentrated alkaline solutions, the primary particle size is controlled in such a manner that the particle size of the precipitated nonferrous metal powder will be decreased as the pH value is increased.

Because organic acids are formed during the reaction, a constant pH value can advantageously be maintained during the reaction by an addition of alkali hydroxide.

In the process according to the invention, oxides or hydroxides of metals are used which in the electrochemical series of the metals are between cadmium and gold and have oxidation-reduction potentials between −0.4 and +1.5 volts.

The oxides or hydroxides which are employed are preferably those of metals Cu, Ag, Ni, Co, Sn, Pb, Sb, As or Bi.

It has been found that mixed metal powders can be coprecipitated from mixed oxides and/or hydroxides of the corresponding different metals. Examples of such mixed metal powders are the combinations copper-nickel and copper-cobalt. The combinations which have been mentioned may be alloylike combinations because examinations with a scanning electron microscope have not revealed any phase difference.

The fine particles nonferrous metal powder which has been produced by the process in accordance with the invention, e.g., a copper powder, may be stabilized by an addition of small quantities of conventional antioxidants, such as oil or soap. Because the fine particles nonferrous metal powder tends to oxidize owing to its large surface area, it is suitably stored under a protective atmosphere consisting, e.g., of nitrogen, argon or carbon dioxide.

The process in accordance with the invention affords advantages. The highly concentrated and in most cases highly basic reaction medium has a high boiling point and is processed under atmospheric pressure, a processing in a pressurized reactor is not required and small stirred reactors may be used.

The consumption of sugar or starch in the process is small. For instance, less than 2 kg sugar per kg of copper metal powder are consumed in the reductive reduction and precipitation of copper.

Because the metal ions need not be maintained in solution for the reaction, high yields per unit of volume, in excess of 300 g metal per liter, can be achieved where suspended metal compounds are used so that the reactor can be emptied without substantial losses after the processing of each batch. If the metal powder is produced with a high conversion, there will be no need to separate oxides from the reaction product.

BRIEF DESCRIPTION OF THE DRAWING

The above and other objects, features and advantages of our invention will become more readily apparent from the following description, reference being made to the accompanying highly diagrammatic drawing in which.

SPECIFIC DESCRIPTION AND EXAMPLES

Figure 1A:
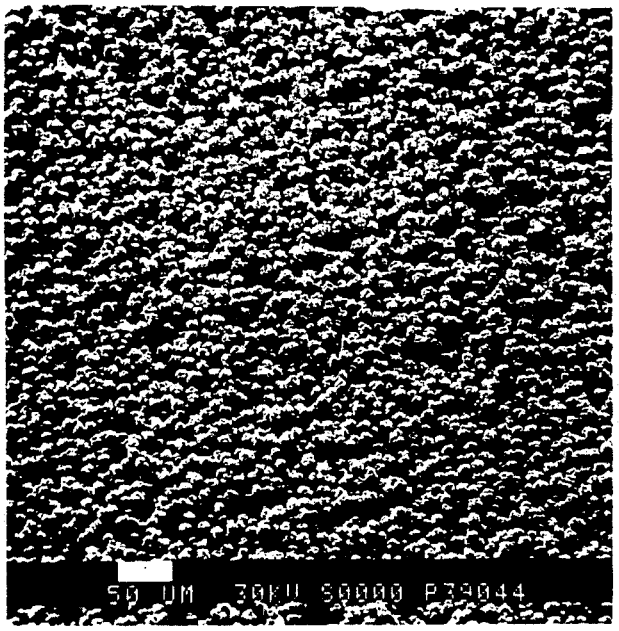
FIGS. 1*a*, 1*b* and 2 are scanning electromicrographs of copper powders made according to the invention.
Figure 1B:
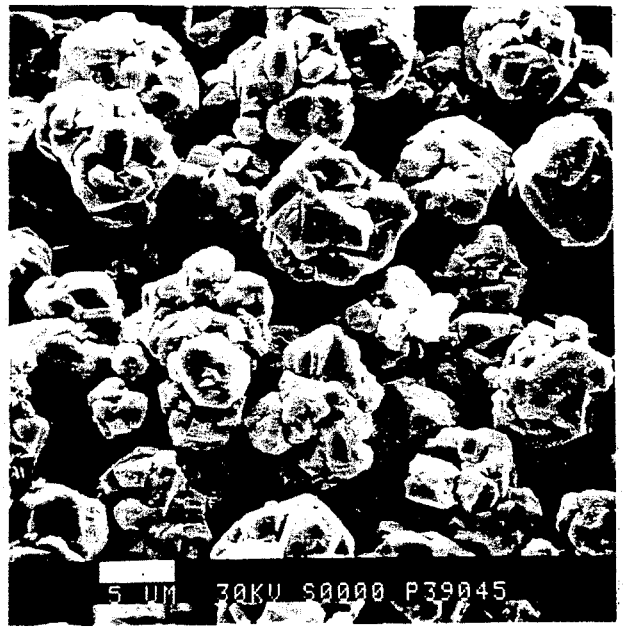
Figure 2:
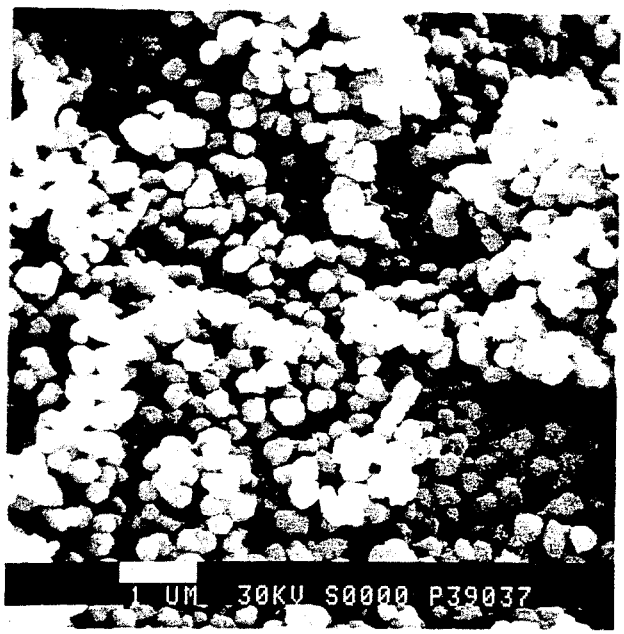

FIGS. 1*a*, 1*b* and 2 are made by a scanning electron microscope. It is apparent that metal powders having a highly regular shape can be produced in accordance with the invention.

EXAMPLE 1

120 g copper hydroxide were suspended in a solution of 180 g fructose in 1000 ml water and after an addition of 30 ml H2O2 the mixture as heated to the boiling point. The pH value decreased to values between 3 and 4 during the reaction. After a processing at the boiling point for 7 hours, 70 g copper powder, corresponding to a yield of 90%, were separated from the reaction medium by a sequence comprising decanting, washing, centrifuging and drying under nitrogen. The copper powder contained 99% copper and under the scanning electron microscope was found to have a particle size of about 12 μm (see FIG. 1*b*).

EXAMPLE 2

300 g copper hydroxide were suspended in a solution of 540 g saccharose in 1000 ml water and the suspension was heated to the boiling point. By a continuous addition of sodium hydroxide solution the pH value was held between 7 and 7.5.

After the reaction medium had been stirred at the boiling point for two hours, a total of 100 g NaOH had been consumed and it was possible to separate 175 g copper powder, corresponding to a yield of 90, by a sequence comprising decanting, washing, centrifuging and drying in a nitrogen stream.

The copper powder contained 99% copper and under a scanning electron microscope was found to have a particle size of about 0.3 μm (see FIG. 2).

EXAMPLE 3

10.13 kg red copper (I) oxide were suspended in a solution of 18 kg fructose in 40 liters water and the suspension was heated to 90° C. while a pH value between 7 and 7.5 was maintained by a continuous addition of a metered sodium hydroxide solution.

After a stirring at 90° C. for 7 hours, a copper powder containing 99% copper and 0.25% oxygen was separated by a sequence comprising decanting, washing, centrifuging and drying under nitrogen.

After the centrifuging the supernatant solution contained copper in a total amount of 19 g, which corresponds to a conversion in excess of 99.5%. Under the scanning electron microscope the copper powder was found to have particle sizes of about 0.3 μm.

EXAMPLE 4

200 g solid NaOH were stirred into 200 ml water, which contained 150 g glucose, and the resulting solution was heated to 90° C. 100 g nickel hydroxide were then added and the mixture was heated to 114° C. with stirring. After a stirring at 114° C. for 6 hours, 50 g nickel, corresponding to a yield of 80%, were isolated by a sequence comprising decanting, washing and drying under nitrogen. It was not possible to detect nickel in the supernatant solution with dimethyl glyoxime. The particle size of the nickel powder was below 5 μm.

EXAMPLE 5

52 g silver carbonate were suspended in a solution of 40 g fructose in 500 ml water and the suspension was stirred at 20° C. A pH value between 7 and 7.5 was maintained by an addition of 7.5 g NaOH. After a reaction time of 7 hours at 20° C. with stirring, 40 g silver powder containing more than 99% silver and corresponding to a yield of 100%, were separated by a sequence comprising decanting, washing and centrifuging. The silver powder had a particle size below 1 μm.

EXAMPLE 6

150 g maltose were dissolved in a mixture of 250 ml water and 250 ml 6N NaOH. 100 g lead acetate (Pb(CH3COO2).3H2O) were then added and the mixture was heated to 105° C. with stirring. After a reaction for 3 hours at 105° C. with stirring, 36 g Sb powder, corresponding to a yield of 57%, were separated by a sequence comprising decanting, washing and centrifuging. The lead powder has a particle size below 3 μm.

EXAMPLE 7

200 g puritose were dissolved in a mixture of 250 ml water and 250 ml 20 NaOH. 100 g bismuth oxide (Bi2O3) were then added and the mixture was heated to 103 ° C. with stirring. A few minutes after the addition 82.3 g Bi powder, corresponding to a yield of 92, were separated by a sequence comprising decanting, washing and centrifuging. The bismuth powder has a particle size below 3 μm.

EXAMPLE 8

200 g solid KOH were stirred into 200 ml water, which contained 80 g maltose. The resulting solution was heated to 90° C. 50 g cobalt chloride were then added and the resulting mixture was heated to 140° C. with stirring. After a stirring at 140° C. for four hours, 18 g cobalt powder, corresponding to a yield of 80%, were separated by a sequence comprising decanting, washing and drying under nitrogen and were found to have a particle size below 3 μm.

EXAMPLE 9

300 g solid KOH were stirred into 300 ml water, which contained 70 g saccharose, and the resulting solution was heated to 90° C. 30 g nickel hydroxide and 10 g copper hydroxide were then added and the resulting mixture was heated to 150° C. with stirring. After a stirring at 150° C. for two hours, 18.5 g metal powder containing 70% nickel and 30% copper and corresponding to a yield of 80% were separated by a sequence comprising decanting, washing and drying under nitrogen. It was not possible to separate the mixture or alloy into its components by means of magnet. The particle size was less than 3 μm.

EXAMPLE 10

300 g solid KOH were stirred into 200 ml water, which contained 100 g saccharose, and the resulting solution was heated to 90° C. 40 g cobalt hydroxide and 10 g copper hydroxide were then added and the resulting mixture was heated to 140° C. with stirring. After a stirring at 140° C. for two hours, 26 g of a magnetic metal powder comprising about 75% cobalt and 20% copper, corresponding to a yield of 80%, were separated by a sequence comprising decanting, washing and drying under nitrogen and were found to have a particle size below 3 μm.

EXAMPLE 11

90 g solid KOH were stirred into 600 ml water, which contained 100 g gluconic acid-delta-lactone and 15 ml 30% hydrogen peroxide and the resulting solution was heated to 100° C. 80 g copper hydroxide were then gradually added with stirring and the mixture was heated at 100° C. with continuous stirring for about 8 hours. 45 g copper powder, corresponding to a yield of 90%, were separated by a sequence comprising decanting, washing and drying under nitrogen and were found to have a particle size below 2 μm.

We claim:

1. A process for producing a powder containing particles of a nonferrous metal, comprising the steps of;

(a)reacting under stirring a substance selected from the group which consists of an oxide, an hydroxide and mixtures thereof of a nonferrous metal in an aqueous medium at a concentration of said substance between 20 and 400 g/l calculated as the metal, with an aqueous sugar or starch solution at a pH above 3.2 and at a temperature between 20° C. to 160° C. to precipitate a powder of the nonferrous metal which is substantially oxide-free; and (b) recovering the precipitated substantially oxide-free nonferrous metal powder from said medium.

2. The process defined in claim 1 wherein said nonferrous metal oxide or hydroxide is at a concentration of 70 and 300 g/l calculated as the metal upon reaction with the sugar or starch.

3. The process defined in claim 1 wherein said temperature in step (a) is maintained between 70° C. and 150° C.

4. The process defined in claim 1, further comprising the step of:

controlling the particle size of the precipitated nonferrous metal powder between substantially 0.1 m by varying the pH of said aqueous medium between 3.2 and 14 with increasing pH corresponding to decreasing particle size.

5. The process defined in claim 1 wherein said nonferrous metal has an oxidation-reduction potential between the oxidation-reduction potential -0.40 volt of cadmium and the oxidation-reduction potential +1.5 volt of gold.

6. The process defined in claim 5 wherein said nonferrous metal is selected from the group which consists of: Cu, Ag, Ni, Co, Sn, Pb, Sb, As and Bi.

7. The process defined in claim 1, further comprising mixing an oxidizer with a solution of a sugar in an amount between 0.5 and 5% related to the sugar.

8. The process defined in claim 7 wherein said nonferrous metal is selected from the group which consists of: Cu, Ag, Ni, Co, Sn, Pb, Sb, As and Bi.

9. The process defined in claim 8 wherein said nonferrous metal oxide or hydroxide is at a concentration of 70 and 300 g/l calculated as the metal upon reaction with the sugar or starch.

10. The process defined in claim 9 wherein said temperature in step (a) is maintained between 70° C. and 150° C.

* * * * *